US009188130B2

(12) United States Patent
Johnson

(10) Patent No.: US 9,188,130 B2
(45) Date of Patent: Nov. 17, 2015

(54) LOCKING DEVICE FOR COOLING FAN ASSEMBLY

(71) Applicant: GM GLOBAL TECHNOLOGY OPERATIONS LLC, Detroit, MI (US)

(72) Inventor: Donnell B. Johnson, Troy, MI (US)

(73) Assignee: GM Global Technology Operations LLC, Detroit, MI (US)

( * ) Notice: Subject to any disclaimer, the term of this patent is extended or adjusted under 35 U.S.C. 154(b) by 506 days.

(21) Appl. No.: 13/737,315

(22) Filed: Jan. 9, 2013

(65) Prior Publication Data

US 2014/0193248 A1 Jul. 10, 2014

(51) Int. Cl.
*F04D 19/00* (2006.01)
*F04D 27/00* (2006.01)
*F04D 29/32* (2006.01)

(52) U.S. Cl.
CPC ..... *F04D 19/002* (2013.01); *F04D 27/008* (2013.01); *F04D 29/326* (2013.01)

(58) Field of Classification Search
CPC ..... F04D 19/002; F04D 25/10; F04D 27/008; F04D 29/326
See application file for complete search history.

(56) References Cited

U.S. PATENT DOCUMENTS

| | | | | |
|---|---|---|---|---|
| 3,575,527 | A * | 4/1971 | Watanabe et al. | 416/32 |
| 3,805,723 | A * | 4/1974 | Bernaerts | 416/247 R |
| 4,289,970 | A * | 9/1981 | Deibert | 416/153 |
| 4,515,511 | A * | 5/1985 | Heerlein | 416/131 |
| 5,921,753 | A * | 7/1999 | Ames | 416/169 R |
| 6,022,193 | A * | 2/2000 | Dubois et al. | 416/169 R |
| 6,422,814 | B1 * | 7/2002 | Dickey et al. | 415/123 |
| 7,306,426 | B2 * | 12/2007 | Franz et al. | 415/123 |

* cited by examiner

*Primary Examiner* — Igor Kershteyn
(74) *Attorney, Agent, or Firm* — Quinn Law Group, PLLC

(57) ABSTRACT

A locking device is provided for a cooling fan assembly. The assembly includes a central hub. A plurality of blades are operatively connected to and configured to selectively rotate around the central hub. A blade ring is fixedly connected to respective outermost radial portions of the plurality of blades. The blade ring may be annularly-shaped and defines at least one blade ring slot. The locking device is configured to selectively prevent the plurality of blades from rotating. The locking device includes a movable member and an actuation device for moving the movable member. The movable member is slidable relative to the blade ring between two positions, an unlocked position that substantially permits the plurality of blades to rotate and a locked position that substantially prevents the plurality of blades from rotating.

18 Claims, 3 Drawing Sheets

LOCKING DEVICE FOR COOLING FAN ASSEMBLY

TECHNICAL FIELD

The disclosure relates generally to a cooling fan assembly, and more particularly, to a locking device for a cooling fan assembly.

BACKGROUND

A vehicle may employ a cooling fan to cool various components of the vehicle, for example, the engine. A cooling fan assembly typically includes a plurality of blades. An electric motor may be used to power or drive the fan, that is, rotate the plurality of blades. When the electric motor is idle, the plurality of blades may continue to rotate, which is sometimes referred to as "wind-milling."

SUMMARY

A locking device is provided for a cooling fan assembly. The assembly includes a central hub. A plurality of blades are operatively connected to and configured to selectively rotate around the central hub. A blade ring is fixedly connected to respective outermost radial portions of the plurality of blades. The blade ring defines at least one blade ring slot. The locking device is configured to selectively prevent the plurality of blades from rotating.

The locking device includes a movable member and an actuation device for moving the movable member. The movable member is slidable relative to the blade ring between two positions, an unlocked position that substantially permits the plurality of blades to rotate and a locked position that substantially prevents the plurality of blades from rotating. The movable member may be movable in a direction substantially perpendicular to a direction of rotation of the blade ring, that is, in a radial direction relative to the central hub.

An electric motor may be operatively connected to the central hub for selectively powering the plurality of blades. The locking device may be configured to prevent the plurality of blades from rotating or "wind-milling" when the blades are not powered, i.e., the electric motor is idle. Employing the locking device reduces aerodynamic drag for a vehicle employing the assembly.

In one embodiment, the actuation device includes an electromagnet having a ferromagnetic core. The electromagnet defines a powered state and a non-powered state. The movable member is configured to be attracted towards and in contact with the ferromagnetic core of the electromagnet when the electromagnet is in the non-powered state. The movable member may be composed of a permanent magnet. The permanent magnet is configured to be repelled by an induced magnetic field generated by the electromagnet when the electromagnet is in the powered state.

The movable member in the unlocked position may be positioned in the blade ring slot such that the movable member rotates with the blade ring and the plurality of blades. The movable member in the locked position may be configured to move away from the blade ring slot.

In another embodiment, the actuation device includes a stator assembly having stator windings. A rotor assembly having a permanent magnet component is positioned within the stator assembly. The rotor assembly is rotatable within and configured to magnetically interact with the stator assembly. A nut member is rigidly connected to and rotatable with the rotor assembly. The nut member defines an internal threaded portion. A screw member is positioned within the nut member and has an external threaded portion interacting with the internal threaded portion of the nut member. The movable member may be operatively connected to the screw member. Alternatively, the movable member may be integrally formed with the screw member. A current flowing through the stator windings is configured to induce motion of the movable member.

The movable member in the locked position may include a jutting portion that extends into the blade ring slot, thereby substantially preventing the plurality of blades and blade ring from rotating. The jutting portion may be configured to slide out of the blade ring slot when the movable member is in the unlocked position.

The above features and advantages and other features and advantages of the present invention are readily apparent from the following detailed description of the best modes for carrying out the invention when taken in connection with the accompanying drawings.

DETAILED DESCRIPTION

Figure 1:
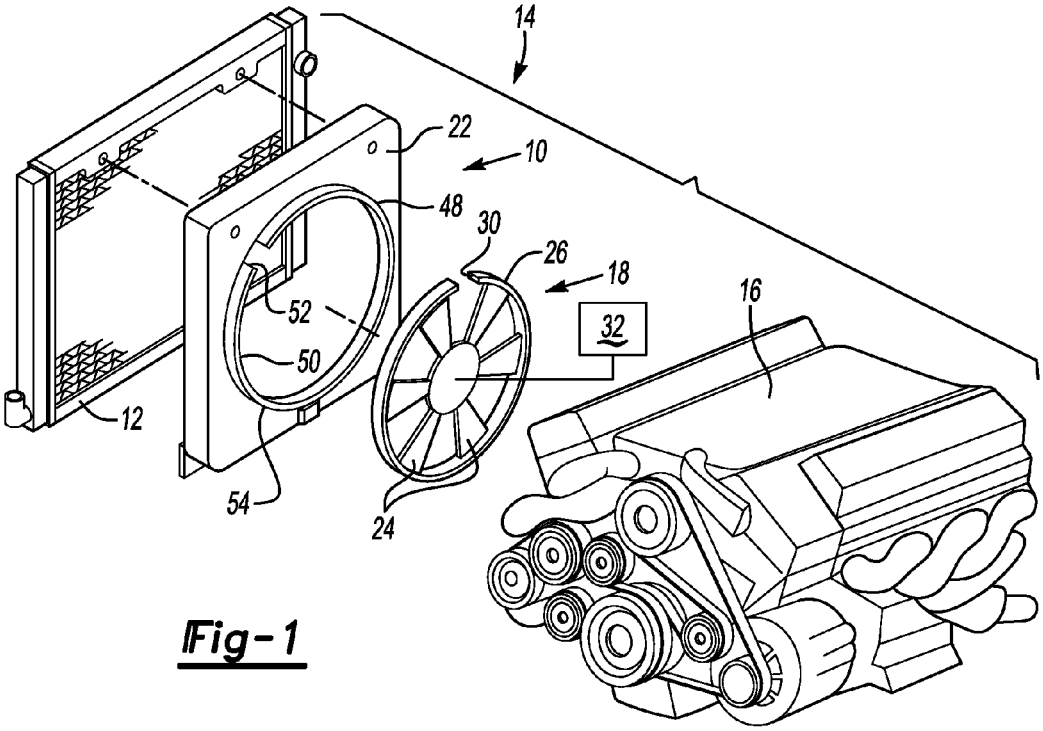
FIG. 1 is a schematic exploded perspective view illustrating a radiator, cooling fan assembly with a locking device and a transversely oriented engine.

Referring to the Figures, wherein like reference numbers refer to the same or similar components throughout the several views, FIG. 1 shows a schematic exploded perspective view of a cooling fan assembly 10 and a radiator 12 in a vehicle 14. An internal combustion engine 16 is illustrated in a transverse orientation and is placed near the assembly 10. The assembly 10 draws cooling air through the radiator 12 in order to cool the internal combustion engine 16.

Figure 2:
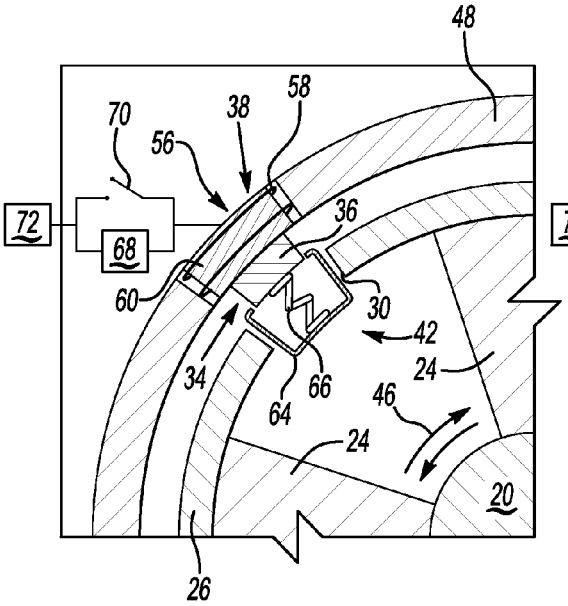
FIG. 2 is a schematic fragmentary sectional view of the cooling fan assembly of FIG. 1, with the locking device in a locked position, in accordance with a first embodiment.
Figure 3:
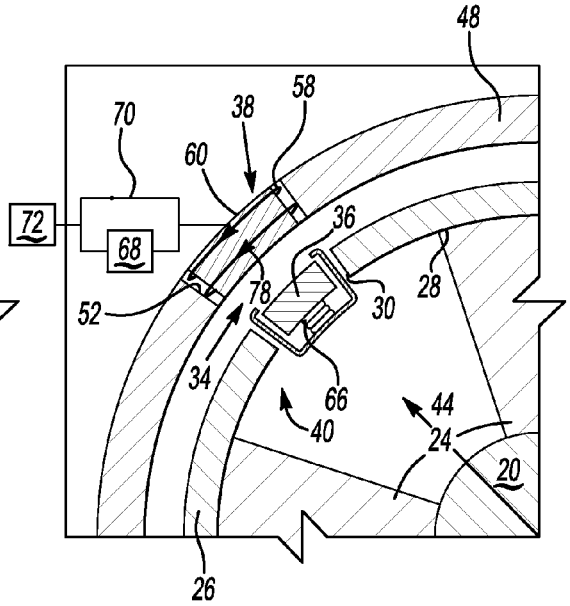
FIG. 3 is a schematic fragmentary sectional view of the cooling fan assembly of FIG. 1, with the locking device in an unlocked position, in accordance with a first embodiment.

The assembly 10 includes a fan 18 having a central hub 20. The fan 18 may be mounted to a fan shroud 22, positioned on the rear side of the radiator 12. FIGS. 2-3 are schematic fragmentary sectional views of the assembly 10. Referring to FIGS. 1-3, a plurality of blades 24 are operatively connected to and configured to selectively rotate around the central hub 20. Referring to FIGS. 1-3, a blade ring 26 is fixedly or rigidly connected to respective outermost radial portions 28 of the plurality of blades 24. The blade ring 26 rotates with the plurality of blades 24. The blade ring 26 may be annularly-shaped or ring-shaped such that it defines an inner and outer circumference. The blade ring 26 may have a circular shape. The blade ring 26 defines at least one blade ring slot 30. In the embodiment shown, the blade ring includes multiple blade ring slots 30. In one non-limiting example, a blade ring slot 30 is formed every 30-60 mm on the blade ring. In another example, the blade ring 26 includes at least 6-12 blade ring slots 30. In another example, the blade ring 26 includes at least twenty blade ring slots 30.

Referring to FIG. 1, an electric motor 32 may be operatively connected to the central hub for selectively powering the plurality of blades 24, in other words, drive the fan 18. When the electric motor 32 is idle, the plurality of blades 24 may continue to rotate, which is sometimes referred to as "wind-milling."

Referring to FIGS. 2-3, the assembly 10 includes a locking device 34 configured to selectively prevent the plurality of blades 24 (and the blade ring 26 to which it is rigidly connected) from rotating. In the embodiments shown, the locking device 34 is configured to prevent the plurality of blades 24 from rotating when the blades 24 are not powered, that is, when the electric motor 32 is idle. Stated differently, the locking device 34 may be configured to prevent "wind-milling." Employing the locking device 34 reduces aerodynamic drag in the vehicle 14 by limiting the exposure of the underhood engine components to impinging high velocity airflow.

Referring to FIGS. 2-3, the locking device 34 includes a movable member 36 and an actuation device 38 for moving the movable member 36. The movable member 36 is slidable relative to the blade ring 26 between two positions, an unlocked position 40 (shown in FIG. 3) that substantially permits the plurality of blades 24 to rotate and a locked position 42 (shown in FIG. 2) that substantially prevents or locks the plurality of blades 24 from rotating. The movable member 36 is movable in a radial direction relative to the central hub 20. Stated differently, the movable member 36 is movable in a direction 44 substantially perpendicular to a direction of rotation (indicated at 46) of the blade ring 26.

Referring to FIGS. 1-3, the assembly 10 includes an exterior ring 48 that is configured to at least partially surround the blade ring 26. Referring to FIG. 1, the blade ring 26 may be positioned within a central opening 50 defined by the exterior ring 48. Referring to FIGS. 1 and 3, the exterior ring 48 defines an aperture 52 on the inner diameter of the exterior ring, referred to herein as the exterior ring aperture 52. Referring to FIG. 1, the exterior ring 48 may be operatively connected to an inner perimeter 54 of the fan shroud 22. The exterior ring 48 may be manufactured as a separate component and fitted or connected to the inner perimeter 54 of the fan shroud. Alternatively, the exterior ring 48 may be integrally formed with the fan shroud 22. The exterior ring 48 may remain stationary relative to the fan shroud 22.

Referring to FIGS. 1-3, the actuation device 38 may be positioned within the exterior ring aperture 52. In the embodiment shown in FIGS. 2-3, the actuation device 38 includes an electromagnet 56. The electromagnet 56 is composed of a coil of wire 58 wrapped around a ferromagnetic core 60. The ferromagnetic core 60 may exhibit high magnetic permeability, a characteristic saturation point, and magnetic hysteresis. Examples of material for the ferromagnetic core 60 include but are not limited to: iron, nickel, cobalt, metal alloys of iron, rare earth metal compounds, and naturally-occurring minerals such as lodestone.

Referring to FIGS. 2-3, a power source 68 may be operatively connected to the electromagnet 56 for selectively powering the electromagnet 56, that is, providing electric current to the coil of wire 58. When electric current is flown in the coil of wire 58, a magnetic field is induced. The induced magnetic field disappears when the electric current is turned off. The strength of magnetic field generated is proportional to the amount of current supplied.

Referring to FIG. 2, a holding device or holder 64 may be inserted into the blade ring slot 30 and configured to anchor or hold the movable member 36. The blade ring 26 may be integrally formed with the holder 64 by injection molding or other methods. Referring to FIGS. 2-3, the locking device 34 includes a biasing member 66 operatively connected to the movable member 36 and configured to bias the movable member 36 toward the locked position 42. The biasing member 66 may be positioned or anchored to the holder 64 in the blade ring slot 30 of the blade ring 26. In the embodiment shown, the biasing member 66 is an extension spring. The biasing member 66 may be a compression spring, torsion spring or any other type of device.

Referring to FIGS. 2-3, in this embodiment, the movable member 36 is at least partially composed of a permanent magnet. The movable member 36 may be entirely composed of a permanent magnet. Any type of suitable permanent magnet may be employed. Referring to FIG. 2, the movable member 36 is configured to be attracted towards and in contact with the ferromagnetic core 60 of the electromagnet 56 when the electromagnet 56 is in a non-powered state, thereby substantially blocking the plurality of blades 24 from rotating.

Figure 6:
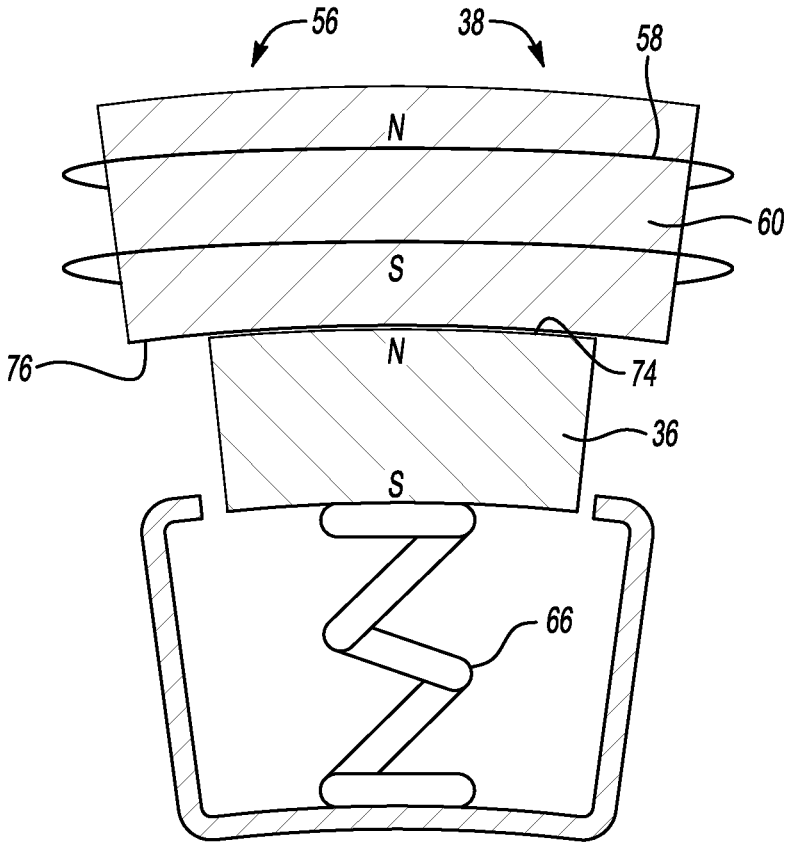
FIG. 6 is a schematic, enlarged portion of FIG. 2, showing a movable member and an actuation device employed in the locking device.

FIG. 6 is an enlarged view of a portion of FIG. 2, showing the movable member 36 and actuation device 38. Referring to FIG. 6, the movable member 36 and ferromagnetic core 60 are oriented with opposing poles facing each other such that the opposing ends 74, 76 of the movable member 36 and ferromagnetic core 60 are attracted and in contact when no current is flowing through the coil of wire 58. For example, referring to FIG. 6, the north pole (N) of the movable member 36 may be positioned adjacent to the south pole (S) of the ferromagnetic core 60. This configuration may be reversed such that the south pole (S) of the movable member 36 is positioned adjacent to the north pole (N) of the ferromagnetic core 60. Referring to FIG. 2, the plurality of blades 24 and blade ring 26 are substantially prevented from rotating when the opposing ends 74, 76 of the movable member 36 and ferromagnetic core 60 are in contact. The ferromagnetic core 60 and the movable member 36 (composed of a permanent magnet) are chosen with sufficient strength in order to overcome any "windmilling' force exerted by the plurality of blades 24. Stated differently, the movable member 36 in the locked position 42 is configured to move away from the blade ring slot 30 in the direction 44. Referring to FIG. 2, the electromagnet 56 in the non-powered state corresponds to the locked position 42 of the movable member 36.

FIG. 3 shows the electromagnet 56 in a powered state. When electric current is flown in the coil of wire 58, a magnetic field is induced by the electromagnet 56. The movable member 36 is configured to be repelled by the induced magnetic field and move towards the blade ring slot 30. More specifically, a sufficient electric current is flown through the coil of wire 58 to induce a magnetic field that will cause the movable member 36 and ferromagnetic core 60 to repel (as shown in FIG. 3) and substantially permit the plurality of blades 24 to rotate. The force of the induced magnetic field must be sufficient to overcome a biasing force of the biasing member 66 in order to push the movable member 36 towards the blade ring slot 30.

Referring to FIG. 3, the direction of current for the coil of wire 58 is chosen such that the movable member 36 is repelled by the induced magnetic field. For example, by employing the direction of current indicated at 78 (shown in FIG. 3), a magnetic field is induced that repels the movable member 36 having a north pole (N) at end 74 (shown in FIG. 6). As is known to those skilled in the art, the direction of a magnetic field induced when an electric current is flown through the coil of wire 58 may be found from what is known as the "right-hand rule." If the fingers of the right hand are curled around the coil of wire 58 in the direction of current flow (defined as conventional current or a flow of positive charge) through the windings, the thumb points in the direction of the north pole (N) of the field inside the coil of wire 58.

Referring to FIG. 3, the electromagnet 56 in the powered state corresponds to the unlocked position 40 of the movable member 36. The movable member 36 in the unlocked position 40 may rotate with the blade ring 26 and the plurality of blades 24. The blade ring 26 and plurality of blades 24 may be counterbalanced for the rotating mass of the movable member and biasing member 66. When the electromagnet 56 is subsequently powered off, the biasing member 66 urges the movable member 36 back to the locked position 42 (see FIG. 2).

Referring to FIGS. 2-3, a switch 70 may be operatively connected to the power source 68 and the actuation device 38. The switch 70 may include an open and a closed position. The actuation device 38 may be in the powered state when the switch 70 is in the closed position. The actuation device 38 may be in the non-powered state when the switch 70 is in the open position. The switch may be any type of switch or device known to those skilled in the art that enable the making and breaking of the respective connections between the second member and the power source. Referring to FIG. 2, the switch 70 may be operatively connected to a vehicle controller 72 such as the engine control unit (ECU) (or a separate controller that is linked to the ECU) to enable an operator to control the operation of the locking device 34.

In summary, referring to FIGS. 2-3, the electromagnet 56 in the powered state is configured to urge the movable member 36 towards the unlocked position 40. The electromagnet 56 in the non-powered state is configured to urge the movable member 36 towards the locked position 42. The configuration described above may be reversed by reversing the direction of current flow through the coil of wire 58 so as to reverse the direction of the magnetic field inside the coil of wire 58. In the embodiment shown, the movable member 36 is substantially bar-shaped. The movable member 36 may be shaped in any form suitable for the particular application. In one non-limiting example, the movable member 36 is approximately 20 mm in diameter and 5 mm in thickness.

Figure 4:
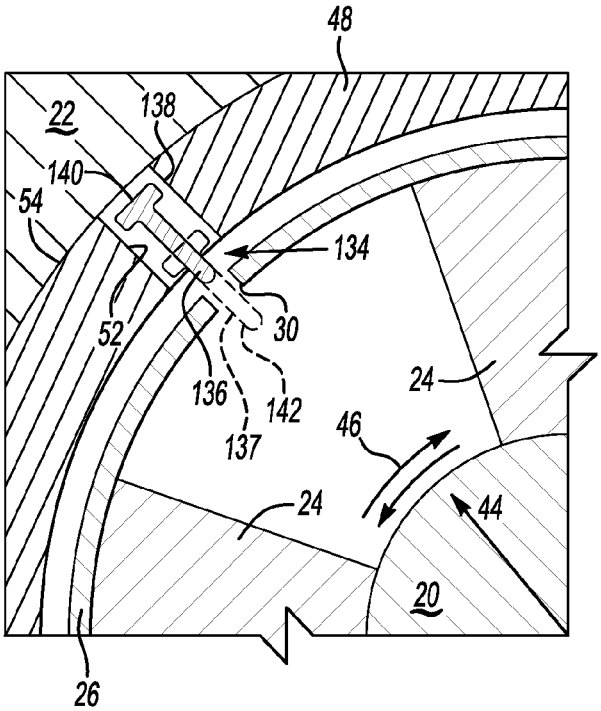
FIG. 4 is a schematic fragmentary sectional view of the cooling fan assembly of FIG. 1, in accordance with a second embodiment.
Figure 5:
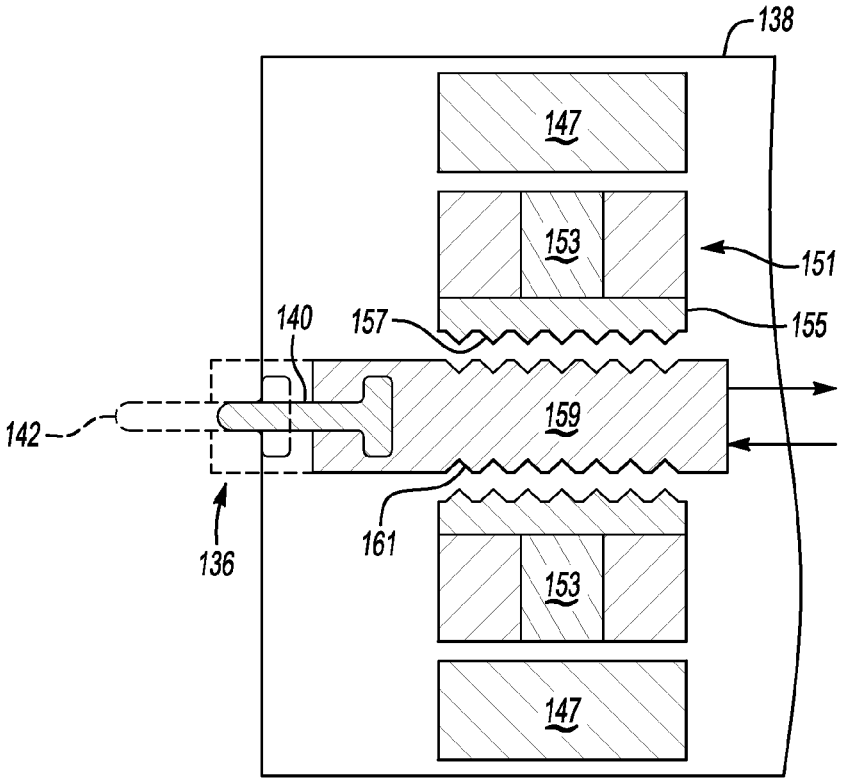
FIG. 5 is a schematic fragmentary sectional view of an example actuation device for the cooling fan assembly of FIG. 4.

A second embodiment of a locking device (indicated generally at 134) is shown in FIGS. 4-5 for the cooling fan assembly 10 of FIG. 1. This embodiment is similar to the first embodiments in all respects other than the differences outlined below and like reference numbers are used to refer to the same or similar components throughout the several views. FIG. 4 is schematic fragmentary sectional view of the locking device 134. The locking device 134 includes a movable member 136 and an actuation device 138. Referring to FIG. 4, the actuation device 138 and the movable member 136 may be positioned within the exterior ring aperture 52 of the exterior ring 48.

Referring to FIG. 4, the movable member 136 is movable in a direction 44 substantially perpendicular to a direction of rotation (indicated at 46) of the blade ring 26. The movable member 136 is slidable relative to the blade ring 26 between two positions, an unlocked position 140 that substantially permits the plurality of blades 24 to rotate and a locked position 142 (shown in phantom) that substantially prevents the plurality of blades 24 from rotating.

Referring to FIG. 4, the movable member 136 includes a jutting portion 137 that extends into the blade ring slot 30 (in the locked position 142), thereby substantially preventing the plurality of blades 24 and blade ring 26 from rotating. Referring to FIG. 4, the jutting portion 137 is configured to slide out of the blade ring slot 30 when the movable member 136 is in the unlocked position 142, thereby substantially permitting the plurality of blades 24 and blade ring 26 to rotate. The movable member 136 may be shaped in the form of a pin. It is to be appreciated that the movable member 136 may be shaped in any form suitable for the particular application. In one non-limiting example, the movable member 136 is approximately 5 mm in diameter and 20 mm long.

Referring to FIG. 4, the actuation device 138 is configured to move or slide the movable member 136 back and forth between the locked and unlocked positions 142, 140 in the direction 44. FIG. 5 is a schematic fragmentary sectional view of an example actuation device 138 that may be used with the movable member 136. Any other suitable type of actuation device 138 may be used.

Referring to FIG. 5, the actuation device 138 may include a stator assembly 147 having stator windings (not shown). A rotor assembly 151 having a permanent magnet component 153 is positioned within the stator assembly 147. The stator windings may be coils (or bar conductors) wound around slots within the stator assembly 147. The stator assembly 147, rotor assembly 151 and permanent magnet component 153 are only schematically depicted in FIG. 5 and may take any shape or form suitable to the particular application at hand. The rotor assembly 151 is rotatable within and configured to magnetically interact with the stator assembly 147. A nut member 155 is rigidly connected to and rotatable with the rotor assembly 151. The nut member 155 defines an internal threaded portion 157. A screw member 159 is positioned within the nut member and has an external threaded portion 161 interacting with the internal threaded portion 157 of the nut member.

Referring to FIG. 5, the movable member 136 may be operatively connected to the screw member 159. Alternatively, the movable member 136 may be integrally formed with the screw member 159. Electric current may be flown through the stator assembly 147 to create an induced magnetic field that interacts with the permanent magnet component 153 of the rotor assembly 151 and applies a rotational force or torque on the rotor assembly 151. The rotation of the rotor assembly 151 causes the nut member 155 to rotate, since the nut member 155 is rigidly connected to or embedded within the rotor assembly 151. The angular motion of the nut member 155 (through the interaction of the internal threaded portion 157 with the external threaded portion 161 of the screw member 159) causes linear motion of the screw member 159 and therefore, the movable member 136. Thus, electric current flowing through the stator assembly 147 is configured to induce motion of the movable member 136. The direction of motion (forwards and backwards) of the movable member 136 may be changed by reversing the polarity of the electric current.

In summary, referring to FIG. 4, the movable member 136 in the locked position 142 is at least partially positioned in the blade ring slot 30, thereby preventing the blade ring 26 and the plurality of blades 24 from rotating. Referring to FIG. 4, the movable member 136 in the unlocked position 140 is configured to slide out or extend out of the blade ring slot 30, towards the exterior ring aperture 52.

The detailed description and the drawings or figures are supportive and descriptive of the invention, but the scope of the invention is defined solely by the claims. While some of the best modes and other embodiments for carrying out the claimed invention have been described in detail, various alternative designs and embodiments exist for practicing the invention defined in the appended claims.

The invention claimed is:

1. A cooling fan assembly comprising:

a central hub;

a plurality of blades operatively connected to and configured to selectively rotate around the central hub;

a blade ring fixedly connected to the plurality of blades, the blade ring defining at least one blade ring slot;

a locking device configured to selectively prevent the plurality of blades from rotating, the locking device including a movable member and an actuation device for moving the movable member; and wherein the movable member is slidable relative to the blade ring between two positions, an unlocked position that substantially permits the plurality of blades to rotate and a locked position that substantially prevents the plurality of blades from rotating.

2. The assembly of claim 1, further comprising:

an electric motor operatively connected to the central hub for selectively powering the plurality of blades; and wherein the locking device is configured to selectively prevent the blades from rotating when the plurality of blades are not powered.

3. The assembly of claim 1, wherein the movable member is movable in a direction substantially perpendicular to a direction of rotation of the blade ring.

4. The assembly of claim 1, further comprising:

an exterior ring configured to at least partially surround the blade ring and defining an inner opening and an exterior ring aperture;

wherein the blade ring is positioned within the inner opening of the exterior ring; and wherein the actuation device is positioned within the exterior ring aperture.

5. The assembly of claim 4, further comprising:

a fan shroud defining an inner perimeter; and wherein the exterior ring is operatively connected to the inner perimeter of the fan shroud.

6. The assembly of claim 1, wherein:

the actuation device includes an electromagnet having a ferromagnetic core, the electromagnet defining a powered state and a non-powered state;

the movable member is composed of a permanent magnet and configured to be attracted towards the ferromagnetic core of the electromagnet when the electromagnet is in the non-powered state; and wherein the movable member is configured to be repelled by an induced magnetic field generated by the electromagnet when the electromagnet is in the powered state.

7. The assembly of claim 6, further comprising:

a power source operatively connected to the electromagnet; and a switch operatively connected to the power source and having an open and a closed position; and wherein the electromagnet is in the powered state when the switch is in the closed position and the electromagnet is in the non-powered state when the switch is in the open position.

8. The assembly of claim 6, wherein:

the movable member in the unlocked position is positioned in the at least one blade ring slot such that the movable member rotates with the blade ring and the plurality of blades; and the movable member in the locked position is configured to move away from the at least one blade ring slot.

9. The assembly of claim 6, further comprising:

a biasing member operatively connected to the movable member and configured to bias the movable member toward the locked position; and wherein the biasing member is positioned within the at least one blade ring slot of the blade ring.

10. The assembly of claim 9, wherein the biasing member is an extension spring.

11. The assembly of claim 1, wherein the actuation device includes:

a stator assembly;

a rotor assembly positioned at least partially within and rotatable within the stator assembly; the rotor assembly having a permanent magnet component;

a nut member rigidly connected to and rotatable with the rotor assembly, the nut member defining an internal threaded portion;

a screw member positioned within the nut member and having an external threaded portion interacting with the internal threaded portion of the nut member; and wherein a current flowing through the stator assembly is configured to induce motion of the movable member.

12. The assembly of claim 11, wherein the movable member is operatively connected to the screw member.

13. The assembly of claim 11, wherein the movable member is integrally formed with the screw member.

14. The assembly of claim 11, further comprising:

an exterior ring configured to at least partially surround the blade ring and defining an inner opening and an exterior ring aperture;

wherein the blade ring is positioned within the inner opening of the exterior ring; and wherein the actuation device and the movable member are positioned within the exterior ring aperture.

15. The assembly of claim 11, wherein:

the movable member in the locked position includes a jutting portion that extends into the at least one blade ring slot, thereby substantially preventing the plurality of blades and blade ring from rotating; and wherein the jutting portion is configured to slide out of the at least one blade ring slot when the movable member is in the unlocked position.

16. A cooling fan assembly comprising:

a central hub;

a plurality of blades operatively connected to and configured to selectively rotate around the central hub, the plurality of blades each defining respective outermost radial portions;

a blade ring fixedly connected to the respective outermost radial portions of the plurality of blades, the blade ring defining at least one blade ring slot;

a locking device configured to selectively prevent the plurality of blades from rotating, the locking device including a movable member and an actuation device for moving the movable member;

wherein the movable member is slidable relative to the blade ring between two positions, an unlocked position that substantially permits the plurality of blades to rotate and a locked position that substantially prevents the plurality of blades from rotating;

wherein the movable member is movable in a direction substantially perpendicular to a direction of rotation of the blade ring;

wherein the actuation device includes an electromagnet having a ferromagnetic core; and wherein the movable member is composed of a permanent magnet.

17. The assembly of claim 16, wherein the ferromagnetic core of the electromagnet is composed of iron.

18. A vehicle comprising:

an engine;

a radiator;

a cooling fan assembly, wherein the assembly includes:

a central hub;

a plurality of blades operatively connected to and configured to selectively rotate around the central hub;

a blade ring fixedly connected to the plurality of blades, the blade ring being annularly-shaped and defining at least one blade ring slot; and a locking device configured to selectively prevent the plurality of blades from rotating, the locking device including a movable member and an actuation device for moving the movable member;

wherein the movable member is slidable relative to the blade ring between two positions, an unlocked position that substantially permits the plurality of blades to rotate and a locked position that substantially prevents the plurality of blades from rotating; and wherein the movable member is movable in a direction substantially perpendicular to a direction of rotation of the blade ring.

* * * * *